US005385305A

United States Patent [19]

Rock et al.

[11] Patent Number: 5,385,305

[45] Date of Patent: Jan. 31, 1995

[54] FUEL INJECTION NOZZLE

[75] Inventors: Jeffrey A. Rock, West Henrietta; Corrine A. Volo, Webster, both of N.Y.

[73] Assignee: General Motors Corporation, Detroit, Mich.

[21] Appl. No.: 168,315

[22] Filed: Dec. 17, 1993

[51] Int. Cl.[6] ..... F02M 55/00

[52] U.S. Cl. ..... 239/533.9; 239/574; 137/117; 138/43

[58] Field of Search ..... 137/117, 625.28; 239/533.3–533.12, 590, 590.3, 574; 138/45, 43, 46

[56] References Cited

U.S. PATENT DOCUMENTS

| | | | |
|---|---|---|---|
| 2,172,556 | 9/1939 | Edwards | 239/574 X |
| 2,297,487 | 9/1942 | L'Orange | 239/574 X |
| 2,934,138 | 4/1960 | Warne | 137/117 X |
| 3,115,923 | 12/1963 | Kellner et al. | 137/117 X |
| 3,143,163 | 8/1967 | Renner | 239/590.3 X |
| 4,262,844 | 4/1981 | Sekiya | 138/45 X |
| 5,070,845 | 12/1991 | Avdenko et al. | 123/470 |

*Primary Examiner*—Andres Kashnikow
*Assistant Examiner*—Kevin P. Weldon
*Attorney, Agent, or Firm*—Karl F. Barr, Jr.

[57] ABSTRACT

A fuel injection nozzle has a tubular body adapted to receive fuel from a fuel line. A restriction member received at the inlet end of the tubular member limits the flow of fuel into the nozzle and is adjustable between minimum and maximum flow rates. The restriction member has an upstream member with a maximum flow orifice through which fuel entering the nozzle passes. A downstream restriction member nests within the upstream member such that a wall of the downstream member is in circumjacent, sliding relationship to a corresponding wall in the upstream member. The downstream member has a minimum flow orifice for establishing the minimum fuel flow into the nozzle and orifices in the wall portion which are blocked by the wall portion of the upstream member in the minimum flow position of the members and are subject to progressive unblocking to thereby establish a flow rate through the nozzle above the minimum.

2 Claims, 1 Drawing Sheet

FUEL INJECTION NOZZLE

TECHNICAL FIELD

The invention relates to a nozzle for discharging fuel to an internal combustion engine.

BACKGROUND

In the fuel injection systems set forth in U.S. Pat. No. 5,070,845 issued Dec. 10, 1991 to Avdenko et al., and copending U.S. patent application Ser. No. 08/143595 filed Nov. 1, 1993, fuel systems are disclosed having fuel injectors for metering fuel to a plurality of fuel nozzles. Fuel is distributed through individual fuel lines and is discharged via the nozzles at locations adjacent the engine intake ports. The nozzles disclosed have bodies with a tubular seat member and an opening for the discharge of fuel therethrough. A poppet valve member is operable, relative to the seat member, to interrupt fuel flow through the opening, and an extension spring anchored to the nozzle body and to the valve member urges the valve into a normally closed position against the seat member.

The nozzle bodies are adapted to receive fuel through restriction members that limit the flow of fuel into the bodies, however, the metering function of the members are limited in their fuel metering precision due to a lack of adjustability. It is desirable to precisely control the flow of fuel through the nozzle upon the opening of the valve in order to meet engine performance requirements as well as emissions regulations for internal combustion engines. For a given application, all nozzles in a particular engine should meter equivalent quantities of fuel to the intake upon application of pressurized pulses of fuel to the nozzles. As such, individual nozzle flow must be adjusted to meet a desired static flow, which is typically controlled through valve stroke and fuel flow into the nozzle body.

SUMMARY OF THE INVENTION

The disclosed invention provides an improved nozzle suitable for use in the fuel injection system of an internal combustion engine in which pressurized fuel is metered to a nozzle.

In a fuel injection system, a tubular nozzle body, adapted to receive fuel from a supply tube, includes a valve seat assembly having first, upstream and second, downstream valve seats, interconnected by a longitudinally extending passage. One or more fluid passages or bypasses extend from upstream of the first valve seat to a location intermediate of the two valve seats. A poppet valve assembly includes first, upstream and second, downstream valve members operable to engage their respective upstream and downstream valve seats to regulate fluid flow through the valve assembly. The poppet valve assembly is urged, by a spring member, towards a normally closed position in which the upstream valve member is in an unseated position relative to its associated valve seat and the downstream valve member is seated against its associated seat. Introduction of a high pressure pulse of fluid into the tubular nozzle body will cause the valve member to move towards an open position in which the upstream valve member is in a seated position and the downstream valve member is unseated to allow flow through the bypass and out of the injector nozzle through the open downstream valve seat.

A restriction assembly is received over the inlet end of the nozzle body to limit fuel flow therethrough. The restriction assembly comprises first and second restriction members, slidingly received, one within the other. Each of the restriction members has a substantially bucket shaped configuration such that the space between the flat, or bottom portions of the two buckets defines a flow chamber or path for fuel transiting the first and second members. A calibrated orifice in each of the restrictor members limits fuel flow through the nozzle by establishing a minimum flow. Portions of the restriction members in circumjacent relationship to one another are slidable, following assembly, to register additional latitudinal openings to fuel flow. The additional openings are useful for flow calibration above the minimum flow established by the calibrated orifices.

Assembly and calibration of the nozzle requires the upstream restrictor member to be predisposed into the fuel supply tube and the downstream member to be pressed onto the inlet end of the nozzle. With the fuel supply tube held so as to prevent movement of the upstream member therein, the nozzle, with downstream restrictor attached, is pressed into the tube and upper restrictor. In a precalibrated position, the latitudinal openings in the downstream restrictor member are blocked by circumjacent wall portions of the upstream member with fuel passage through the nozzle limited to that quantity permitted by the minimum flow, calibrated orifices. Such fuel flow is sufficient for fuel system and nozzle testing prior to final flow adjustment.

Final calibration of flow through the nozzle requires further pressing of the nozzle assembly into the fuel supply tube, and captive upstream restrictor member, so as to expose a portion of the latitudinal openings to fuel flow between the two members until the desired flow through the nozzle is achieved.

The details, as well as other features and advantages of the preferred embodiment of the fuel injection nozzle employing features provided by this invention are set forth in the following detailed description and drawings.

DETAILED DESCRIPTION

Figures 1, 2, 3:
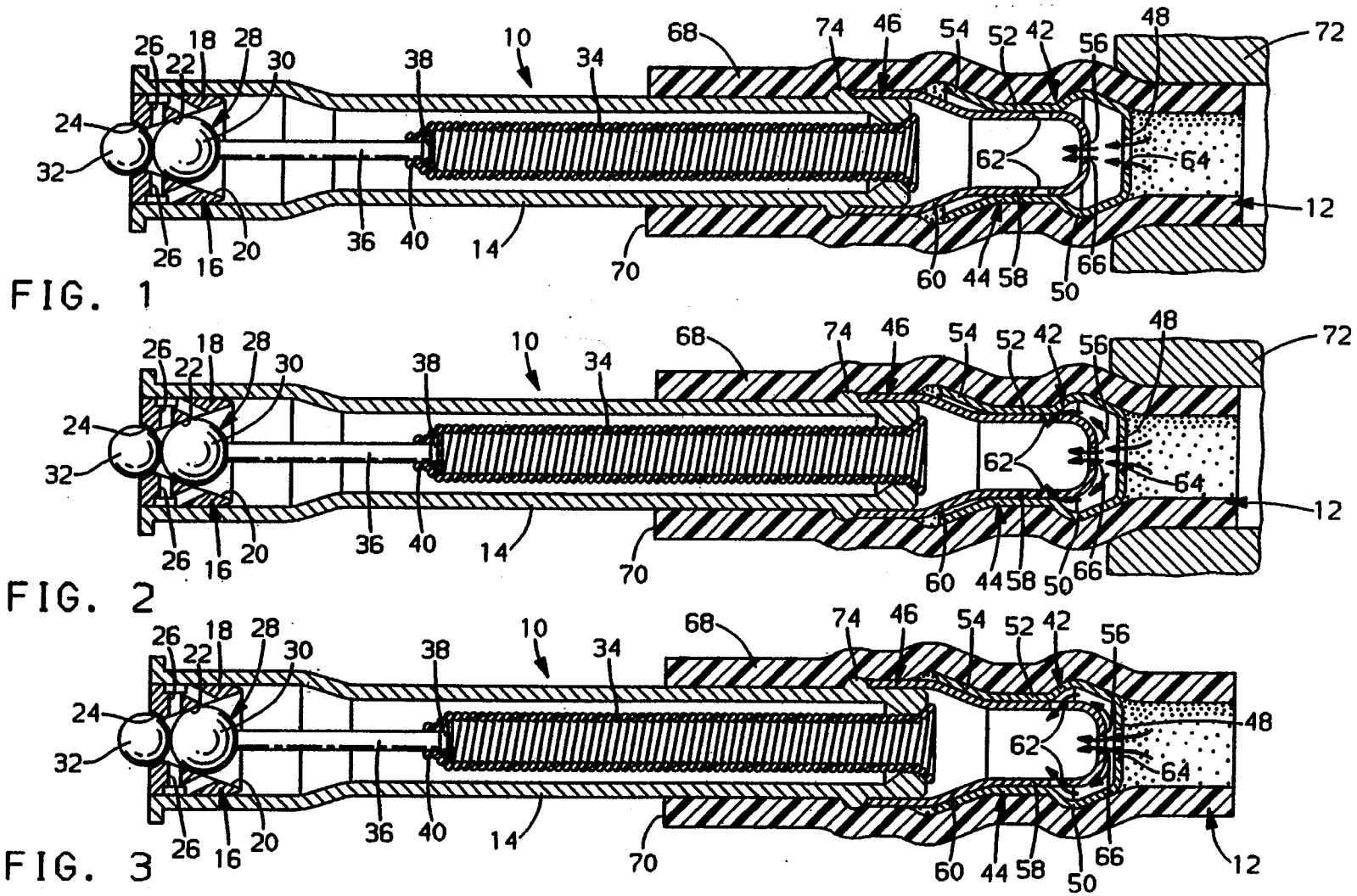
FIG. 1 is a sectional view of a fuel nozzle showing features of its construction.
FIG. 2 is a sectional view of the nozzle of FIG. 1 in a calibration configuration.
FIG. 3 is a sectional view of the nozzle of FIG. 1 in a second, calibrated configuration.

Referring to the drawings, FIGS. 1, 2 and 3 illustrate a fuel injection nozzle, designated generally as 10, for delivery of fuel to the intake system of an internal combustion engine, not shown. The nozzle 10 receives fuel, in the form of pressurized pulses, from a fuel distribution line 12. In a preferred embodiment, the fuel line 12 is constructed of a flexible material having suitable durability in a fuel environment.

The nozzle 10 has a tubular body 14 adapted to receive fuel from its associated fuel line 12. The downstream end of the tubular body 14 receives a tubular valve seat assembly 16 which includes a valve seat body 18 which is fixed within the tubular body 14 such as by an interference fit between the two components, or by welding, or otherwise bonding, so as to establish a leak free seal therebetween. The valve seat body 18 has a passage 20 extending longitudinally from the upstream to the downstream ends with upstream and downstream valve seats 22,24 extending about opposite ends of the passage such that the valve seats are situated in spaced relationship to one another with the seating surface of the upstream seat 22 facing upstream and the seating surface of the downstream seat 24 facing downstream. Fluid passages or bypasses 26 formed in the valve seat body 18 extend from upstream of valve seat 22 to a location intermediate of the two valve seats.

A poppet valve assembly, designated generally as 28, includes upstream valve member 30 engageable with upstream valve seat 22 to interrupt flow from within the tubular body 14 into longitudinal passage 20. A second, downstream valve member 32 engages downstream valve seat 24 to interrupt flow from passage 20 and out of nozzle 10. The valve members are operably connected to form unitary valve assembly 28 having a fixed longitudinal movement or stroke, relative to the valve seats 22,24.

A helically coiled extension spring 34 is anchored to the tubular body 14 and to the upstream valve member 30 through a shank 36, attached to valve member 30 by welding or otherwise bonding. The shank 36 has a head 38 which is surrounded by a section of reduced coils 40 of extension spring 34 to thereby anchor the spring to the valve member 30. The extension spring 34 is operable to urge the valve assembly 28 towards an upstream, closed direction in which downstream valve member 32 is normally biased to engage its associated valve seat 24, precluding fuel flow from nozzle 10. Upon introduction of a highpressure pulse of fuel into the tubular body 14 causing the pressure differential across valve assembly 28 to reach a desired level, the bias exerted thereon by the extension spring 34 is overcome and the valve assembly is urged in the downstream, open direction such that the upstream valve member 30 engages associated valve seat 22 and downstream valve member 32 is displaced from seat 24 to allow fuel to flow from tubular body 14 through passages 26 and out of the injector nozzle 10 through open downstream valve and seat 32,24, respectively.

A restriction assembly 42 is received over the inlet end of the tubular body 14 and may be calibrated to limit fuel flow to, and to provide the primary flow metering function in, the fuel injection nozzle 10. The restriction assembly comprises upstream and downstream, substantially bucket-shaped restriction members 44,46, slidingly received or nesting, one within the other. The upstream restriction member 44 has a bottom 48, situated at the upstream end thereof, with a bulbous side portion 50 adjacent the bottom, a cylindrical wall 52 adjacent the bulbous side portion 50 and an outwardly sloped, frustoconically shaped portion 54 terminating in an open, downstream end. Downstream restriction member 46 has a bottom 56, also situated at the upstream end thereof, with a cylindrical wall 58 adjacent the bottom and an outwardly sloped, frustoconically shaped portion 60 terminating in an open, downstream end. One or more latitudinal metering orifices 62 are located in the cylindrical wall 58 of downstream restriction member 46. In a preferred embodiment the orifices 62 are located at the end of the cylindrical wall portion 58 adjacent to the bottom 56 of the bucket shaped restriction member 46, however, the metering orifices 62 may also be located at axially varying positions should a wider range of nozzle adjustment, to be described in greater detail below, be desirable. Upon initial assembly of downstream restrictor member 46 within the upstream restrictor member 44, cylindrical wall portion 58 of the downstream member circumjacently contacts cylindrical wall portion 52 of the upstream member, in a sliding relationship such that latitudinal metering orifices 62 are closed by the cylindrical wall 52, FIG. 1. In this precalibration mode, fuel flow through the nozzle 10 is limited to flow through metering orifices 64 and 66 in the bottoms 48, 56 of the nested restrictor members 44,46.

Flow rate through the nozzle 10 can be further adjusted by sliding the downstream restriction member 46 further into the upstream member. As restriction member 46 moves into member 44, the latitudinal metering orifices 62 located in the cylindrical wall portion 58 of member 46 register with fuel flowing through the bulbous portion 50 of the upstream member, FIG. 2. The bulbous portion 50 of member 44 defines a passage for fuel to flow from metering orifice 64 and into the tubular body 14 through orifices 62 as well as 66 for injection through the valve assembly 28. By adjusting the axial relationship of the downstream restriction member 46 within the upstream member 44, registration of the latitudinal metering orifices 62 in cylindrical wall 58 with pressure fuel in bulbous portion 50 of member 44, can be varied thereby varying fuel flow into the tubular body 14.

With respect to minimum fuel flow through nozzle 10, only metering orifice 66 in downstream restriction member 46 is configured to meter the flow of incoming fuel to a minimum flow value. Metering orifice or opening 64 in upstream restriction member 44 must be sized to allow sufficient additional flow, above the minimum, to satisfy the flow requirements of the latitudinal metering orifices 62. As such, the metering orifice 64 in upstream restriction member 44 defines a maximum flow value for the fuel injection nozzle 10. The end result of the application of the restriction assembly 42 disclosed herein is a nozzle having a continuously variable inlet flow rate between a minimum flow value defined by metering orifice 66 and a maximum flow rate defined by metering orifice 64.

To prevent over-insertion of the downstream restriction member 46 into upstream member 44, and potential blockage of fuel flow through bulbous portion 50, frustoconical portions 54 and 60 of the members 44 and 46 define limiting stops for relative axial movement between the members. FIG. 3 illustrates the members in a fully inserted configuration.

Assembly and adjustment of the disclosed fuel injection nozzle 10 is as follows. Upstream restriction member 44 is inserted into the end 70 of flexible fuel line 12 and, downstream metering member 46 is placed over the inlet end of the tubular body 14. A clamping member 72, FIGS. 1 and 2, locates member 44 within the fuel line 12 and prevents movement thereof during assembly. Tubular body 14, with restriction member 46 attached, is inserted into the fuel line 12 such that cylindrical wall portion 58 of member 46 engages corresponding cylindrical wall portion 52 of member 44 closing latitudinal metering orifices 62 to fuel flow, as illustrated in FIG. 1. Pressurized fluid from a source is introduced into line 12 to initiate flow through nozzle 10. In the precalibrated configuration described thus far, flow through the nozzle is limited by the minimum flow metering orifice 66. Following initiation of minimum fluid flow, nozzle body 14 with attached downstream restriction member 46 is further inserted into the fuel line 12 and upstream restriction member 44 such that latitudinal orifices 62 in cylindrical wall portion 58 are moved into communication with the fuel in bulbous portion 50 of upstream member 44. As the latitudinal orifices 62 begin to register with bulbous portion 50, FIG. 2, pressurized fuel entering the upstream member 44 through metering orifice 66 will begin to flow through the orifices 62 as well as minimum flow orifice 66, thereby increasing flow into the tubular body 14. Insertion of the tubular body 12 into the fuel line 12 is halted when the area of the uncovered orifices 62 is sufficient to achieve a desired fuel flow through the nozzle as measured by flow out of the valve seat 24. Bottoming of the frustoconical portion 60 of downstream restriction member 46 against corresponding frustoconical portion 54 of upstream member 44, FIG. 3, places a limit on the insertability of the two members 44,46 of the restriction assembly, into one another. Should flow through the nozzle be insufficient upon reaching the stop position, the nozzle 10 is defective or the flow through the inlet line is inadequate.

Following calibration of the fuel injection nozzle 10, the clamping member 72 is removed from the fuel line 12, FIG. 3. The outwardly protruding configuration of the nozzle assembly within the fuel line 12 at locations such as 74, acts to prevent movement of the fuel line and restriction members relative to one another.

The fuel injection nozzle disclosed herein has an adjustable fuel inlet for varying the fuel flow through the nozzle. The inlet allows several nozzles in a single engine application to be flow balanced. Such a flow balancing capability compensates for injector flow variation resulting from manufacturing inconsistencies and system variation.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiments described were chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

The embodiments of the invention in which and exclusive property or privilege is claimed are defined as follows:

1. A fuel injection nozzle comprising a tubular body having inlet and outlet means, said inlet means adapted to receive fuel from a source, fuel restriction means disposed upstream of said outlet in communication with said inlet, said restriction means comprising a first minimum flow orifice, a second maximum flow orifice and a third variable flow orifice, said first orifice operable to define a minimum fuel flow into said tubular body, said second orifice operable to define a maximum fuel flow into said tubular body and said third, variable orifice adjustable to define a desired fuel flow into said tubular body between said minimum flow rate and said maximum flow rate.

2. A fuel injection nozzle comprising a tubular body having inlet and outlet means, said inlet means adapted to receive fuel from a source, fuel restriction means disposed upstream of said outlet in communication with said inlet, said restriction means comprising an upstream restriction member having a flow orifice through which fuel entering said tubular body passes and a wall portion, and a downstream restriction member having a minimum flow orifice through which fuel entering said tubular body passes and calibrated to establish a minimum fuel flow into said tubular body, said downstream restriction member further comprising a wall portion having a metering orifice therein, said wall portion of said downstream restriction member in circumjacent sliding relationship with said wall portion of said upstream restriction member, said members moveable from a first position in which said wall portion of said upstream member closes said metering orifice in said adjacent wall portion in said downstream member to a second position in which said metering orifice in said wall portion of said downstream member is uncovered to establish fuel flow therethrough to define a flow rate into said tubular body above said minimum flow rate.

* * * * *